US007322834B2

(12) United States Patent
Hu et al.

(10) Patent No.: US 7,322,834 B2
(45) Date of Patent: Jan. 29, 2008

(54) ELECTRICAL CONNECTOR WITH IMPROVED CONTACTS

(75) Inventors: Jin-Kui Hu, Kunshan (CN); Guo-Hua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/414,691

(22) Filed: Apr. 28, 2006

(65) Prior Publication Data

US 2006/0246754 A1 Nov. 2, 2006

(30) Foreign Application Priority Data

Apr. 28, 2005 (CN) ..... 2005 2 0071492 U

(51) Int. Cl.
*H01R 12/00* (2006.01)

(52) U.S. Cl. ..... 439/83; 439/700

(58) Field of Classification Search ..... 439/83, 439/876, 700, 573
See application file for complete search history.

(56) References Cited

U.S. PATENT DOCUMENTS 4,828,503 A * 5/1989 Gilissen et al. ..... 439/62
4,954,087 A * 9/1990 Lauks et al. ..... 439/71
5,427,535 A * 6/1995 Sinclair ..... 439/66
5,807,123 A * 9/1998 Spiegelaar et al. ..... 439/188
6,083,059 A * 7/2000 Kuan ..... 439/862
6,102,735 A * 8/2000 Chen et al. ..... 439/573
6,155,856 A * 12/2000 Sanada ..... 439/246
6,290,524 B1 * 9/2001 Simmel ..... 439/289
6,290,555 B1 * 9/2001 Nubuyuki et al. ..... 439/876
6,402,567 B1 * 6/2002 Zhu ..... 439/700
6,501,665 B1 * 12/2002 Ted ..... 361/808
6,783,405 B1 * 8/2004 Yen ..... 439/824
6,855,010 B1 * 2/2005 Yen ..... 439/700
6,957,987 B2 * 10/2005 Ma et al. ..... 439/733.1
7,154,286 B1 * 12/2006 Marx et al. ..... 324/761
2004/0266272 A1 * 12/2004 Maruyama et al. ..... 439/700
2005/0266734 A1 * 12/2005 Kazama ..... 439/700

* cited by examiner

*Primary Examiner*—Hae Moon Hyeon
*Assistant Examiner*—Harshad C Patel
(74) *Attorney, Agent, or Firm*—Wei Te Chung

(57) ABSTRACT

An electrical connector (1) for mounting to a circuit board includes a dielectric housing (10) and a number of conductive contacts (20) positioned in the housing. The dielectric housing has a mounting surface and a top surface opposite thereto, and defines a number of passageways (11) extending therein and opened to the top surface. Each conductive contact has a body portion (22) secured in the passageway of the dielectric housing, a mating portion (21) extending from one end of the body portion, a stretch portion (23) extending from the other end of the body portion, and a solder portion (24) connected with the stretch portion and extending outwardly.

14 Claims, 4 Drawing Sheets

ELECTRICAL CONNECTOR WITH IMPROVED CONTACTS

BACKGROUND OF THE INVENTION

1. Field of the Invention

The present invention generally relates to an electrical connector, and more particularly to an electrical connector mounting on a circuit board and to facilitate slight movement after which is soldered thereto.

2. Description of Related Art

Electrical connectors are widely used to interconnect electronic components and subcomponents to circuit boards to form functioning devices. In the condition of repeatedly mating and unmating with corresponding complementary connectors or circuit boards, the connections between the contacts of the connector and the circuit board may not be reliable. It is conventional to use auxiliary elements such as fasteners/screws mounted to the electrical connector and the circuit board to enhance such connection therebetween. Obviously, the connector is needed to be able to be adjusted during fixing process by screw. However, it is difficult to make the gap between the screw hole and contacts absorbed because the electrical connectors are immovable after soldering.

Hence, an improved electrical connector is desired to overcome the problems mentioned above.

BRIEF SUMMARY OF THE INVENTION

Accordingly, an object of the present invention is to provide an electrical connector which is movable after soldering to a circuit board.

In order to achieve the above-mentioned object, an electrical connector for mounting to a circuit board includes a dielectric housing defining a mounting face confronting to the circuit board and a top face opposite thereto and a plurality of conductive contacts. The dielectric housing defines a plurality of passageways extending therethrough and opened to the top face. Each conductive contacts has a body portion secured in the passageway of the dielectric housing, a mating portion extending from one edge of the body portion and beyond the top face, a stretch portion extending from the other edge of the body portion, and a solder portion connected with the stretch portion and extending outside of the dielectric housing. The stretch portion is deflectable with respect to the circuit board after the conductive contacts being soldered on said circuit board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
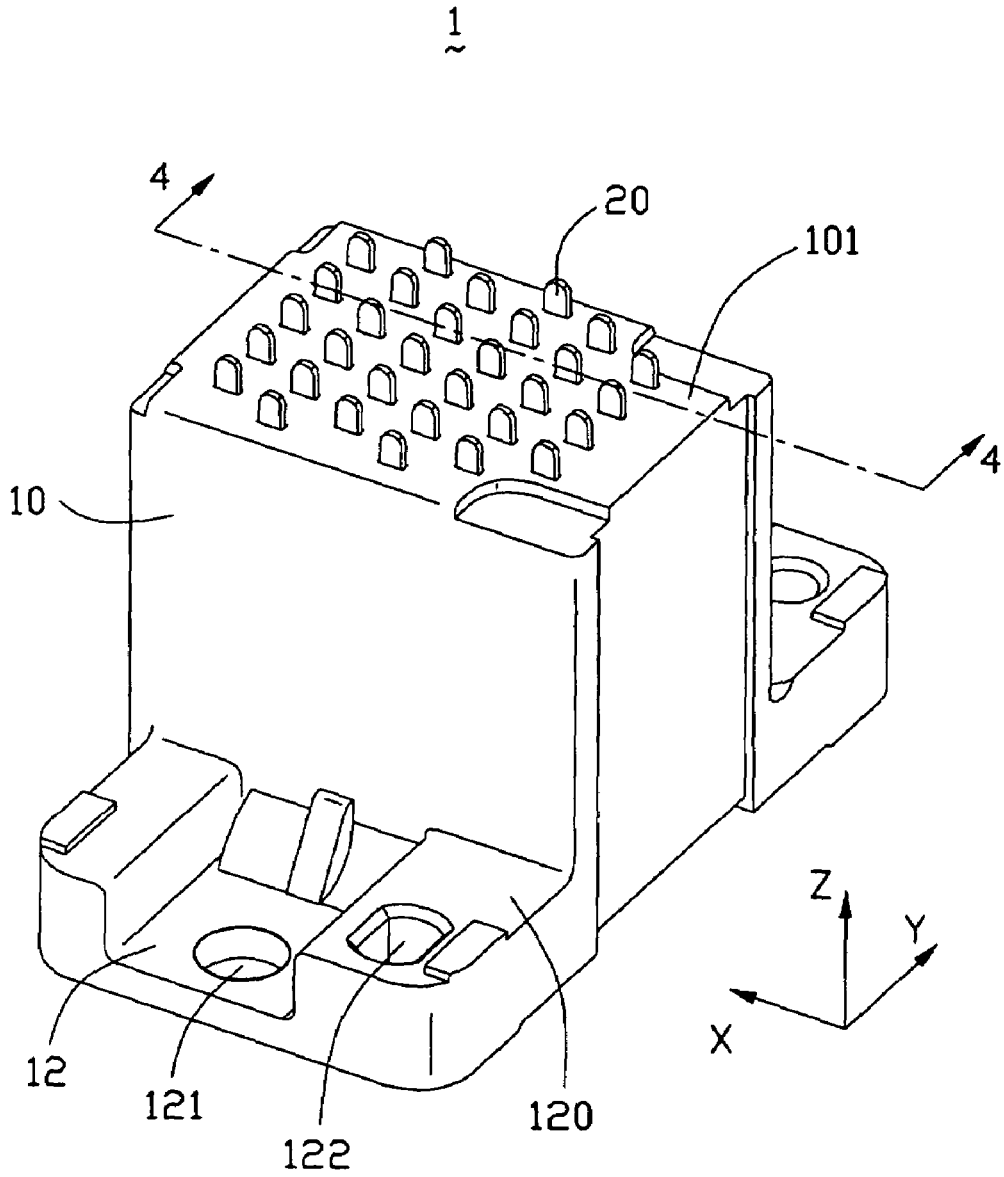
FIG. 1 is a perspective view of an electrical connector in accordance with the present invention.

Reference will now be made to the drawing figures to describe the present invention in detail.

Referring to FIGS. 1-4, an electrical connector 1 in accordance with the present invention, which is adapted for mounting on a circuit board defining a plurality of through holes 40, comprises an integrated, one-piece rectangular dielectric housing 10 and a plurality of conductive contacts 20 assembled to the dielectric housing 10.

Figure 2:
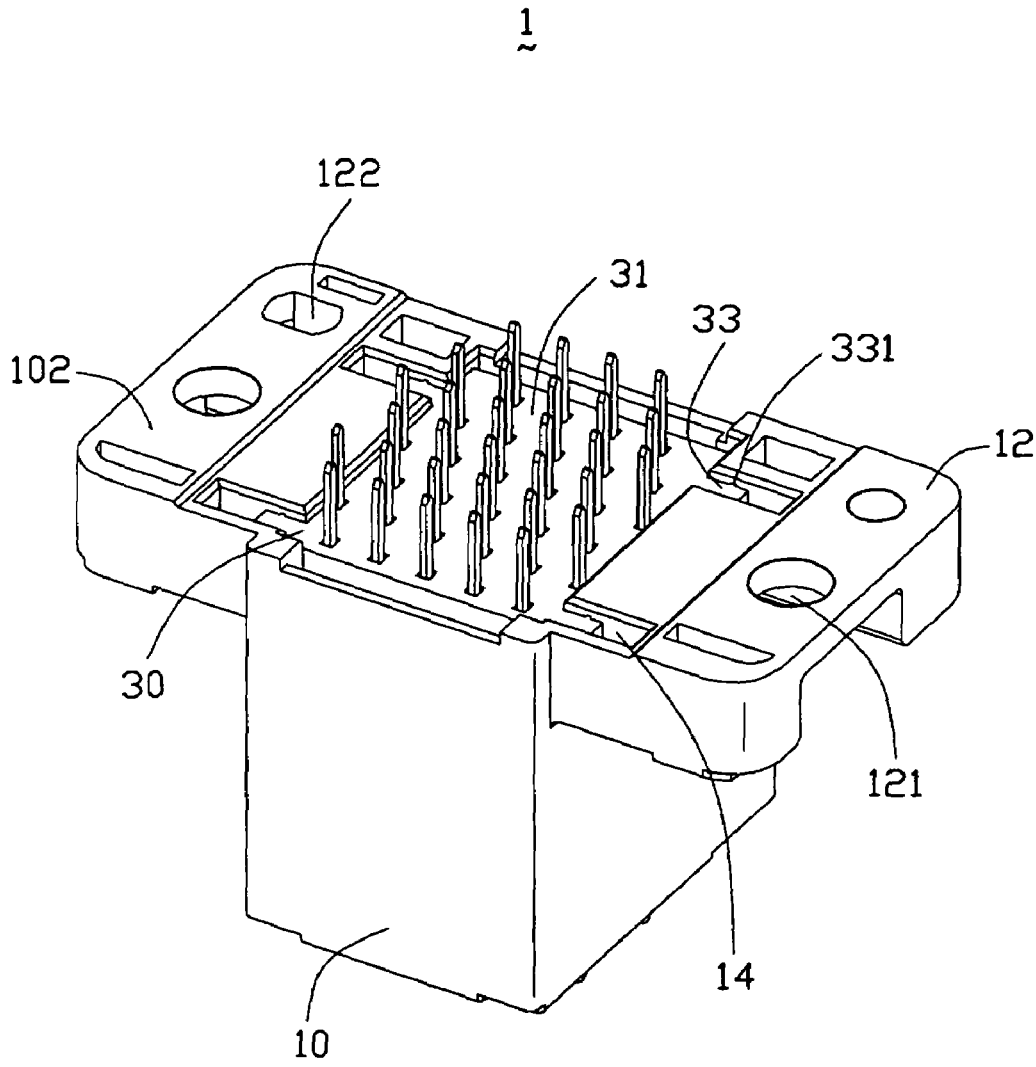
FIG. 2 is a view similar to FIG. 1, but viewed from a different angle.
Figure 4:
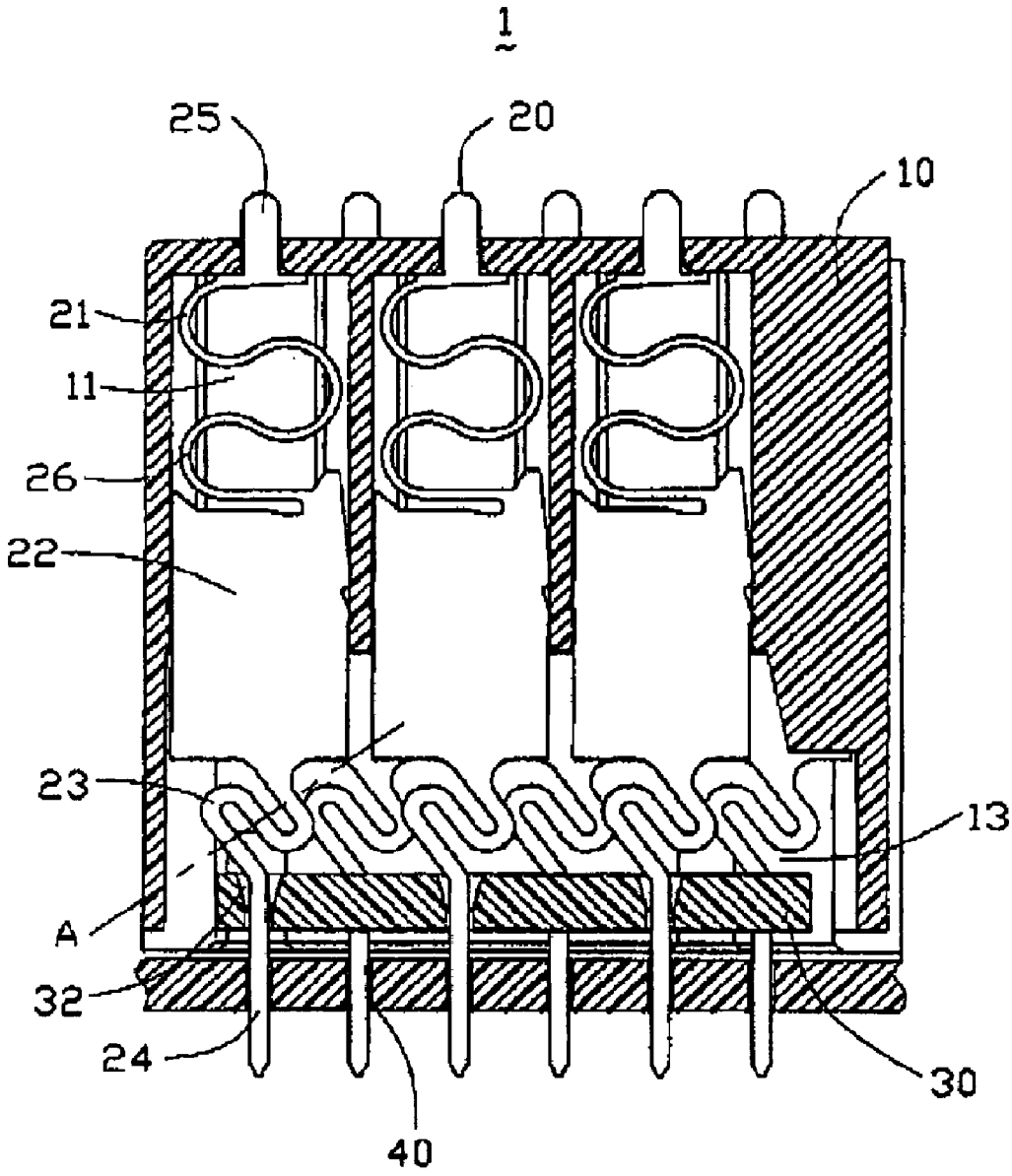
FIG. 4 is a cross-section view of the FIG. 1.

Referring to FIGS. 1-2 and 4, the dielectric housing 10 has a top, mating face 101 confronting to the circuit board and a mounting face 102 opposite thereto, and comprises a plurality of passageways 11 extending therethrough and opened to the top face 101. The passageways 11 are arranged in a rectangular grid array for receiving corresponding conductive contacts 20. The dielectric housing 10 forms two wing portions 12 at the opposite side thereof. Each wing portion 12 has a protrusion 120 and a guiding hole 122 defined therein. Each wing portion 12 further includes an opening 121 for receiving a fastener (not shown) or the like for securing the electrical connector 1 to the circuit board with the mounting face 102 of the dielectric housing 10 facing a top surface of the circuit board. The dielectric housing 10 defines a recess 13 proximate the plurality of the passageways 11 and communicated therewith. The recess 13 is opened to the mounting face 102 of the dielectric housing 10 and includes a plurality of slits 14.

Figure 3:
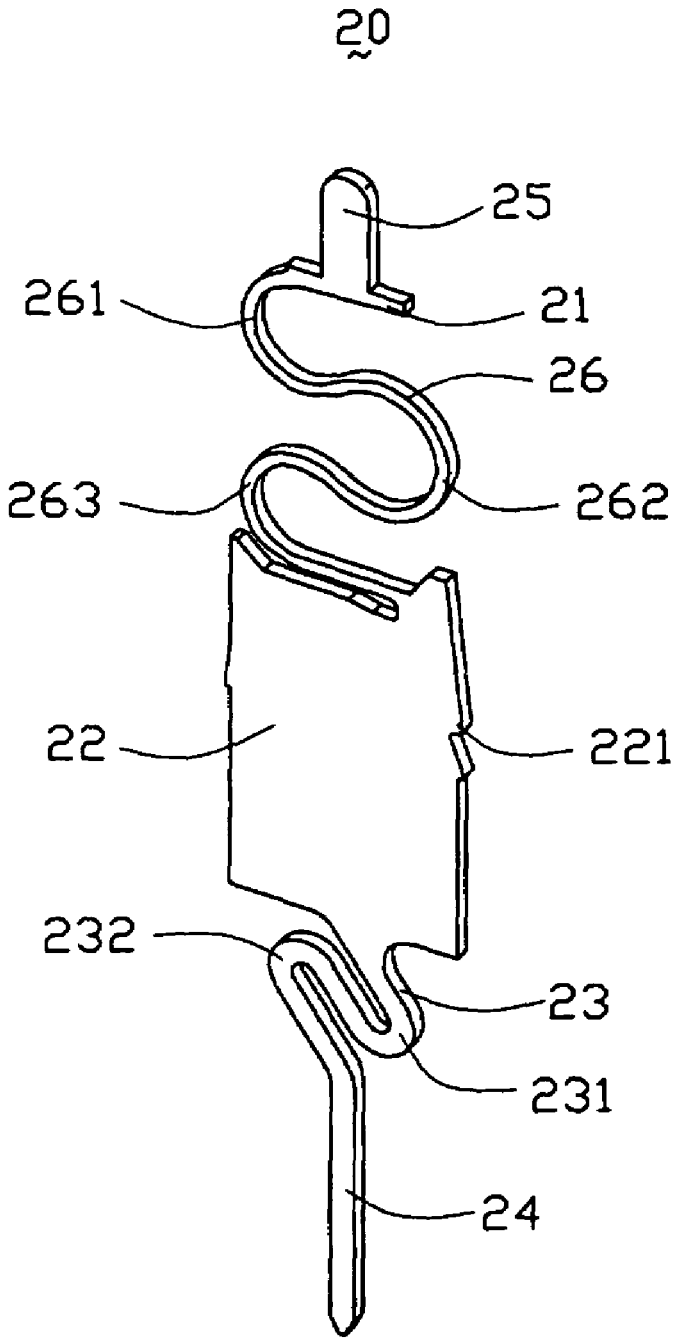
FIG. 3 is a perspective view of a conductive contact of the electrical connector of the present invention.

Referring to FIG. 3, each conductive contact 20 soldering to the circuit board and electrically connecting with a complementary electrical components comprises a rectangular planar, body portion 22, a mating portion 21 extending from a top edge of the body portion 22, a stretch, resilient spring portion 23 extending from a bottom edge of the body portion 22, and a solder portion 24 connected with the stretch portion 23. The mating portion 21 includes a spring portion 26 connected with the body portion 22 and a contact portion 25 extending upwardly from the spring portion 26. The solder portion 24 extends in a direction perpendicular to the circuit board, which is opposite to the contact portion 25 thereof. The solder portion 24 extends through the through hole 40 of the circuit board. The widths of stretch portion 23 and spring portion 26 are substantially equal to the thickness of the conductive contact 2 and the width of the body portion 22 is larger than the thickness of the conductive contact 2.

The stretch portion 23 is a general slanted S-shaped and defines a first U-shaped portion 231 and a second U-shaped portion 232 to allow movements in X, Y and Z directions, Z representing an up and down movement relative to the circuit board in which the electrical connector is mounted, and X and Y representing movements in the plane parallel to the circuit board in which the electrical connector is mounted all as represented by the arrows shown in FIG. 1. The stretch portion 23 defines thereof a basic axis A extending obliquely relative to the circuit board. The spring portion 26 includes a first arc portion 261 connected with the contact portion 25, a third arc portion 263 connected with the body portion 22, and a second arc portion 262 extending therebetween. The body portion 22 is provied with a plurality of barbs 221 along two opposite lateral edges thereof for interference fit in corresponding passageway 11 of the dielectric housing 10.

Referring to FIGS. 2 and 4, in the preferred embodiment, the electrical connector 1 further includes a spacer 30 attached to the dielectric housing 10. The spacer 30 defines a main body 31 and four retention blocks 33 each having a plurality of ribs 331 thereon. A plurality of cavities 32 corresponding to the conductive contacts 20 are defined in the main body 31.

Referring to FIG. 4, in assembly, the body portions 22 of the conductive contacts 20 are secured in the passageways 11. The spring portions 26 are received in the passageways 11 and the stretch portions 23 are received in the recess 13. The contact portion 25 of the conductive contact 20 is exposed beyond the top face 101 of the dielectric housing 10. The main body 31 of the spacer 30 is received in the recess 13 of the dielectric housing 10 and the ribs 331 of the retention blocks 33 are interference with the slits 14. The solder portions 24 of the conductive contacts 20 are respectively received in the cavities and extending therethrough for soldering to the circuit board.

After the conductive contacts 20 soldering to the circuit board, the mating portion 21 can move in the Z direction and the solder portion 24 is immovable relative to the circuit board. But as can be appreciated, slight movement is provided by the spring characteristics of the stretch portion 23 and is intended within a range of the elastic properties of the spring. Therefore, the electrical connector 1 can adjust position of which to overcome the mounting tolerance of the process of the solder and result in an accurate orientation for fixing a fastener to further securing the electrical connector the circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a circuit board, comprising:

a dielectric housing defining a mounting face and a top face opposite thereto, said dielectric housing defining a plurality of passageways extending therethrough and opened to the top face; and a plurality of conductive contacts each having a rectangular body portion secured in the passageway of the dielectric housing, a mating portion extending from one edge of the body portion and beyond the top face, a stretch portion extending from the other edge of the body portion, and a solder portion connected with the stretch portion and extending outside of the dielectric housing; wherein said stretch portion is deflectable with respect to the body portion after the contacts are soldered on said circuit board; and wherein said dielectric housing further defines a recess proximate the passageways and communicating therewith, the stretch portions of the conductive contacts being received in the recess.

2. The electrical connector as claimed in claim 1, wherein said mating portion further includes a contact portion and a spring portion, and wherein the spring portion is located between the contact portion and the body portion.

3. The electrical connector as claimed in claim 1, wherein said stretch portion has a slanted S-shape.

4. The electrical connector as claimed in claim 2, wherein the spring portion includes a first arc portion connected with the contact portion, a third arc portion connected with the body portion, and a second arc portion located therebetween.

5. The electrical connector as claimed in claim 2, wherein the width of the spring portion is substantially equal to the thickness of the conductive contact and the width of the body portion is larger than the thickness of the conductive contact.

6. The electrical connector as claimed in claim 2, wherein the width of the stretch portion is substantially equal to the thickness of the conductive contact and the width of the body portion is larger than the thickness of the conductive contact.

7. The electrical connector as claimed in claim 1, further comprising a spacer defining a plurality of cavities and received in the recess, wherein the solder portions of the conductive contacts are extending through the cavities.

8. The electrical connector as claimed in claim 1, wherein the dielectric housing defines a pair of wing portions at two sides thereof, and wherein each wing portion includes an opening for receiving a fastener to thereby secure the connector on the circuit board.

9. A conductive contact adapted for being received in a dielectric housing and mounted to a circuit board to electrically connect with a complementary component, comprising:

a body portion adapted for interferentially engaging with said dielectric housing;

a mating portion extending from one edge of the body portion;

a stretch portion extending from the other edge of the body portion; and a tail portion connecting with the stretch portion;

wherein the mating portion is deflectable in a direction Z and the stretch portion is movable in directions X, Y and Z.

10. The conductive contact as claimed in claim 9, wherein said mating portion further includes a contact portion and a spring portion, wherein the spring portion is located between the contact portion and the body portion.

11. The conductive contact as claimed in claim 9, wherein said stretch portion defines a first slanted U-shaped portion and a second slanted U-shaped portion.

12. The conductive contact as claimed in claim 10, wherein the spring portion includes a first arc portion connected with the contact portion, a third arc portion connected with the body portion, and a second arc portion located therebetween.

13. The conductive contact as claimed in claim 10, wherein the width of the spring portion is substantially equal to the thickness of the conductive contact and the width of the body portion is larger than the thickness of the conductive contact.

14. An electrical connector assembly comprising:

a printed circuit board defining a plurality of through holes;

an insulative housing positioned upon the printed circuit board and defining a plurality of passageways extending therethrough;

a plurality of contacts retainably disposed in the corresponding passageways, respectively; and each of said contacts defining a soldering tail extending from a main body thereof and outside of the housing; wherein said solder tail includes a straight end extending through the through hole and soldered to the printed circuit board and a serpentine section above said straight end so as to provide horizontal deflection thereof;

wherein said serpentine section further provides vertical deflection thereof;

wherein said serpentine section defines thereof a basic axis extending obliquely relative to the printed circuit board.

* * * * *